US011415040B1

(12) United States Patent
Smith et al.

(10) Patent No.: US 11,415,040 B1
(45) Date of Patent: Aug. 16, 2022

(54) HEATING OIL FOR ENHANCED ACTIVE THERMAL COOLANT SYSTEM

(71) Applicant: GM Global Technology Operations LLC, Detroit, MI (US)

(72) Inventors: Michael A. Smith, Clarkston, MI (US); Robert Gallon, Northville, MI (US); Andrew A. Raftopoulos, Auburn Hills, MI (US); Eugene V. Gonze, Pinckney, MI (US); Bryan K. Pryor, Clarkston, MI (US); Sergio Quelhas, Ann Arbor, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/184,886

(22) Filed: Feb. 25, 2021

(51) Int. Cl.

| | |
|---|---|
| ***F01P 3/06*** | (2006.01) |
| ***F01M 11/00*** | (2006.01) |
| ***F01P 3/08*** | (2006.01) |
| *F01P 3/00* | (2006.01) |

(52) U.S. Cl.
CPC ..... *F01P 3/06* (2013.01); *F01M 11/0004* (2013.01); *F01P 3/08* (2013.01); *F01P 2003/006* (2013.01); *F01P 2025/40* (2013.01)

(58) Field of Classification Search
CPC .... F01P 3/06; F01P 2003/006; F01P 2025/40; F01P 3/08; F01M 11/0004
See application file for complete search history.

(56) References Cited

U.S. PATENT DOCUMENTS

| | | | | |
|---|---|---|---|---|
| 8,955,474 | B1 * | 2/2015 | Derbin | F01P 3/08 123/41.31 |
| 2013/0179049 | A1 * | 7/2013 | Grieser | F01P 3/06 701/102 |
| 2013/0192545 | A1 * | 8/2013 | Bidner | F01M 11/10 123/196 R |
| 2013/0206083 | A1 * | 8/2013 | Wood | F01M 1/16 123/495 |

FOREIGN PATENT DOCUMENTS

| | | | |
|---|---|---|---|
| KR | 20040029739 | * | 4/2004 |

* cited by examiner

*Primary Examiner* — Syed O Hasan
(74) *Attorney, Agent, or Firm* — Vivacqua Crane PLLC

(57) ABSTRACT

A method for thermal management of a motor vehicle engine includes one or more of the following: determining a current lube oil temperature; determining a lube oil temperature for optimal friction; turning on piston cooling jets based on the current lube oil temperature and the lube oil temperature for optimal friction; and turning off the piston cooling jets.

13 Claims, 2 Drawing Sheets

HEATING OIL FOR ENHANCED ACTIVE THERMAL COOLANT SYSTEM

INTRODUCTION

The present disclosure relates to a coolant system for motor vehicles. More particularly, the present disclosure relates to utilizing heated lube oil for enhanced cooling.

A typical motor vehicle utilizes an internal combustion engine for power generation. The internal combustion engine is coupled to a coolant system to maintain the optimal operating temperature of the engine. Specifically, cooled coolant is transmitted from a radiator to an engine block and cylinder heads, while heated coolant is transmitted back to the radiator.

While current coolant systems achieve their intended purpose, there is a need for a new and improved system and method for a coolant system that optimizes friction in the engine and control of particular emissions.

SUMMARY

According to several aspects, a method for thermal management of a motor vehicle engine includes one or more of the following: determining a current lube oil temperature; determining a lube oil temperature for optimal friction; turning on piston cooling jets based on the current lube oil temperature and the lube oil temperature for optimal friction; and turning off the piston cooling jets.

In an additional aspect of the present disclosure, the method further includes deciding if the current lube oil temperature is lower than an optimal temperature, wherein if the current lube oil temperature is not lower than the optimal temperature, the piston cooling jets are turned off.

In another aspect of the present disclosure, the method further includes deciding if a piston temperature is above a PM generation threshold when the current lube oil temperature is lower than the optimal temperature, wherein if the piston temperature is not above the PM generation threshold, the piston cooling jets are turned off.

In another aspect of the present disclosure, the method further includes deciding if a target lube oil temperature is achieved after the piston cooling jets are turned on.

In another aspect of the present disclosure, the method further includes deciding if piston heat rejection for knock suppression is utilized when the target lube oil temperature is achieved, wherein if a piston heat rejection for knock suppression is not utilized, the piston cooling jet are turned off.

In another aspect of the present disclosure, the method further includes deciding if a demanded total lube flow is greater than a current lube flow when the target lube oil temperature is not achieved of when the piston heat rejection for knock suppression is utilized.

In another aspect of the present disclosure, if the demanded total lube flow is not greater than the current lube flow, the piston cooling jets are turned on.

In another aspect of the present disclosure, the method further includes deciding if a lube oil pump is operating at maximum capacity when the demanded total lube flow is greater than the current lube flow.

In another aspect of the present disclosure, if the lube oil pump is not operating at maximum capacity, the piston cooling jets are turned on.

In another aspect of the present disclosure, if the lube oil pump is operating at maximum capacity, the piston cooling jets are turned off.

In another aspect of the present disclosure, the piston cooling jets provide knock mitigation by operating the piston cooling jets above a target temperature for knock suppression.

In another aspect of the present disclosure, the piston cooling jets cool the lube oil with active control of the thermal management system with active cooling of the lube oil to a sump to achieve a target lube oil sump temperature.

According to several aspects, a method for thermal management of a motor vehicle engine includes one or more of the following: determining a current lube oil temperature; determining a lube oil temperature for optimal friction; turning on piston cooling jets based on the current lube oil temperature and the lube oil temperature for optimal friction; turning off the piston cooling jets; deciding if the current lube oil temperature is lower than an optimal temperature, wherein if the current lube oil temperature is not lower than the optimal temperature, the piston cooling jets are turned off; and deciding if a piston temperature is above a PM generation threshold when the current lube oil temperature is lower than the optimal temperature, wherein if the piston temperature is not above the PM generation threshold, the piston cooling jets are turned off.

In another aspect of the present disclosure, the method further includes deciding if a target lube oil temperature is achieved after the piston cooling jets are turned on.

In another aspect of the present disclosure, the method further includes deciding if piston heat rejection for knock suppression is utilized when the target lube oil temperature is achieved, wherein if a piston heat rejection for knock suppression is not utilized, the piston cooling jet are turned off.

In another aspect of the present disclosure, the method further includes deciding if a demanded total lube flow is greater than a current lube flow when the target lube oil temperature is not achieved of when the piston heat rejection for knock suppression is utilized.

In another aspect of the present disclosure, if the demanded total lube flow is not greater than the current lube flow, the piston cooling jets are turned on.

In another aspect of the present disclosure, the method further includes deciding if a lube oil pump is operating at maximum capacity when the demanded total lube flow is greater than the current lube flow.

In another aspect of the present disclosure, if the lube oil pump is not operating at maximum capacity, the piston cooling jets are turned on.

In another aspect of the present disclosure, if the lube oil pump is operating at maximum capacity, the piston cooling jets are turned off.

According to several aspects, a method for thermal management of a motor vehicle engine includes one or more of the following: determining a current lube oil temperature; determining a lube oil temperature for optimal friction; turning on piston cooling jets based on the current lube oil temperature and the lube oil temperature for optimal friction; turning off the piston cooling jets; deciding if the current lube oil temperature is lower than an optimal temperature, wherein if the current lube oil temperature is not lower than the optimal temperature, the piston cooling jets are turned off; deciding if a piston temperature is above a PM generation threshold when the current lube oil temperature is lower than the optimal temperature, wherein if the piston temperature is not above the PM generation threshold, the piston cooling jets are turned off; deciding if a target lube oil temperature is achieved after the piston cooling jets are turned on; deciding if piston heat rejection for knock suppression is utilized when the target lube oil temperature is achieved, wherein if a piston heat rejection for knock suppression is not utilized, the piston cooling jet are turned off; deciding if a demanded total lube flow is greater than a current lube flow when the target lube oil temperature is not achieved of when the piston heat rejection for knock suppression is utilized, wherein if the demanded total lube flow is not greater than the current lube flow, the piston cooling jets are turned on; and deciding if a lube oil pump is operating at maximum capacity when the demanded total lube flow is greater than the current lube flow.

In another aspect of the present disclosure, if the lube oil pump is not operating at maximum capacity, the piston cooling jets are turned on, and wherein if the lube oil pump is operating at maximum capacity, the piston cooling jets are turned off.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
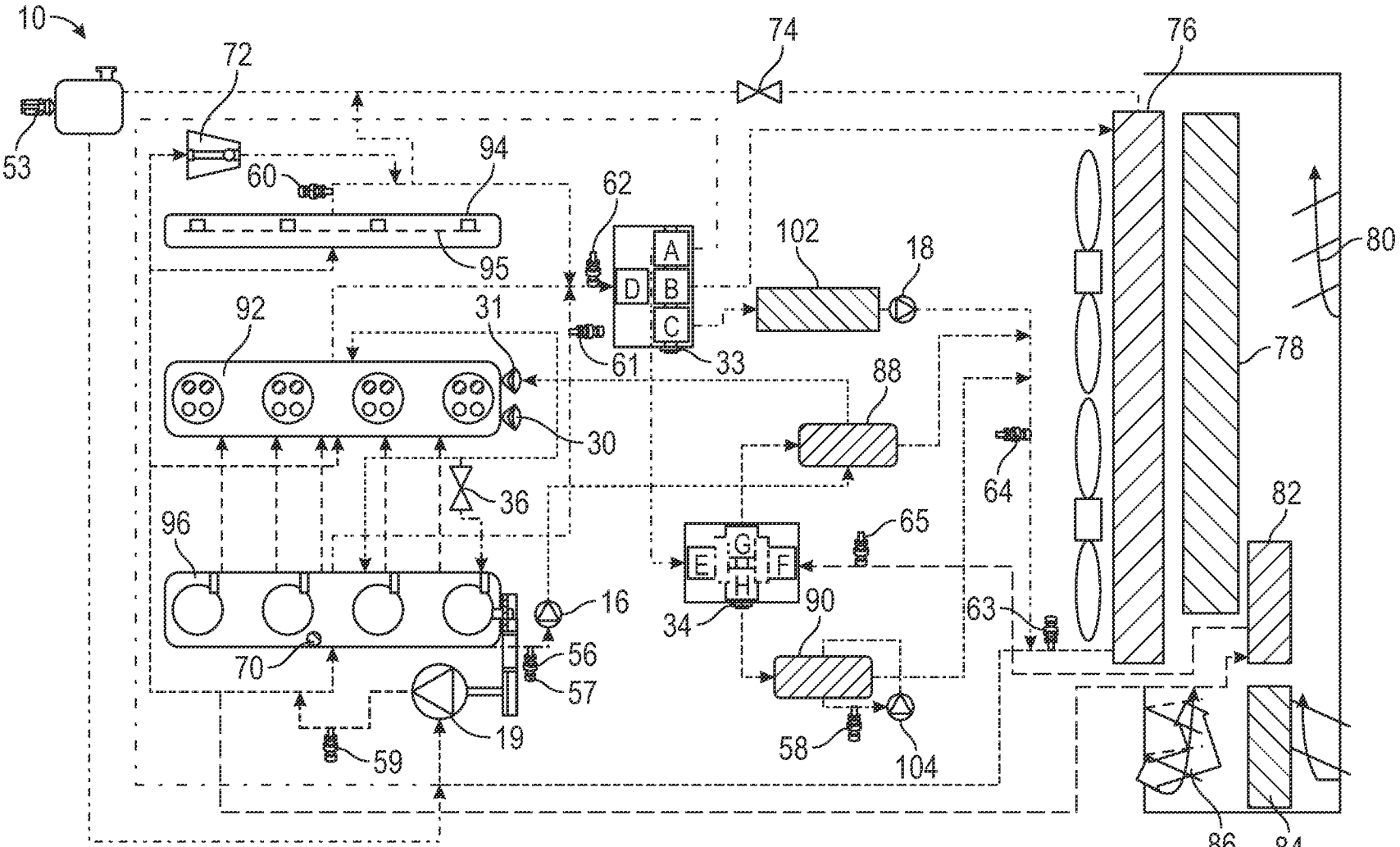
FIG. 1 is a schematic diagram of a coolant system for a motor vehicle according to an exemplary embodiment.

Referring to FIG. 1, there is shown a coolant system 10 for a motor vehicle. The coolant system 10 is under the control of an electronic control module (ECM). The coolant system 10 includes a radiator 76, a condenser 78 and a second pass radiator 82. Air intake into the coolant system 10 occurs through upper aero shutters 80, lower aero shutters 84 and rear air dam shutters 86. The heated fluid in the coolant system 10 is indicated by the double dot, dashed lines and the dot, dashed lines. The cooled fluid is indicated by the small dashed lines and the large dashed lines. A surge tank with a surge tank dual pressure sensor 53 is in fluid communication with the radiator 76 through a check valve 74.

During the operation of the coolant system 10, cooled coolant fluid 63 is transmitted to a mechanical pump 19, which in turn pumps cooled coolant fluid 59 to an engine block 96, a set of cylinder heads 92, a turbine 72 and a turbo charger 94, which includes an independent exhaust manifold 95. Note that FIG. 1 shows a set of four cylinders in the engine block 96 and corresponding piston heads 92. In various arrangements, there are as few as two cylinders and corresponding cylinder heads, while in other arrangements there are greater than four cylinders and corresponding cylinder heads. In some arrangements, the engine block 96 includes a block heater 70, for example, for cold weather operation.

Heated coolant fluid 61 from the engine block 96 is transmitted to a main rotary valve 33; heated coolant fluid 60 is transmitted from the turbo charger 94 to the main rotary valve 33; and heat coolant fluid 62 is transmitted from the cylinder heads 92 to the main rotary valve 33.

Heated coolant fluid is transmitted directly to the radiator 76 and to a heat exchanger 102. An auxiliary coolant pump 18 pumps the heated coolant fluid 64 to the cooled coolant fluid 63.

Heated coolant fluid is also transmitted to an oil rotary valve 34, which also receives fluid 65 from the second pass radiator 82. Cooled coolant fluid is transmitted from the oil rotary valve to an engine oil heat exchanger 88 and a transmission oil heat exchanger 90, which are both in fluid communication with the heat coolant fluid 64, as indicated by dotted, dashed lines. A transmission oil temperature sensor 58 monitors the temperature of the transmission oil as a transmission oil pump 104 pumps transmission oil through the transmission oil heat exchanger 90.

The engine oil heat exchanger 88 is in fluid communication with the cylinder heads 92 through cam phaser intake 30 and a cam phaser exhaust 31. Engine oil is pump from the engine block 96 with a continuously variable displacement oil pump 16 to the engine oil heat exchanger 88. A temperature sensor 56 and a redundant temperature sensor 57 monitor the temperature of the engine oil from engine block 96. When desired, a piston cooling jet solenoid opens to inject cooling jets of oil into the engine block 96.

In various arrangements, the ECM is a non-generalized, electronic control device having a preprogrammed digital computer or processor, memory or non-transitory computer readable medium used to store data such as control logic, software applications, instructions, computer code, data, lookup tables, etc., and a transceiver [or input/output ports]. Computer readable medium includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device. Computer code includes any type of program code, including source code, object code, and executable code. The ECM is configured to execute the code or instructions.

Figure 2:
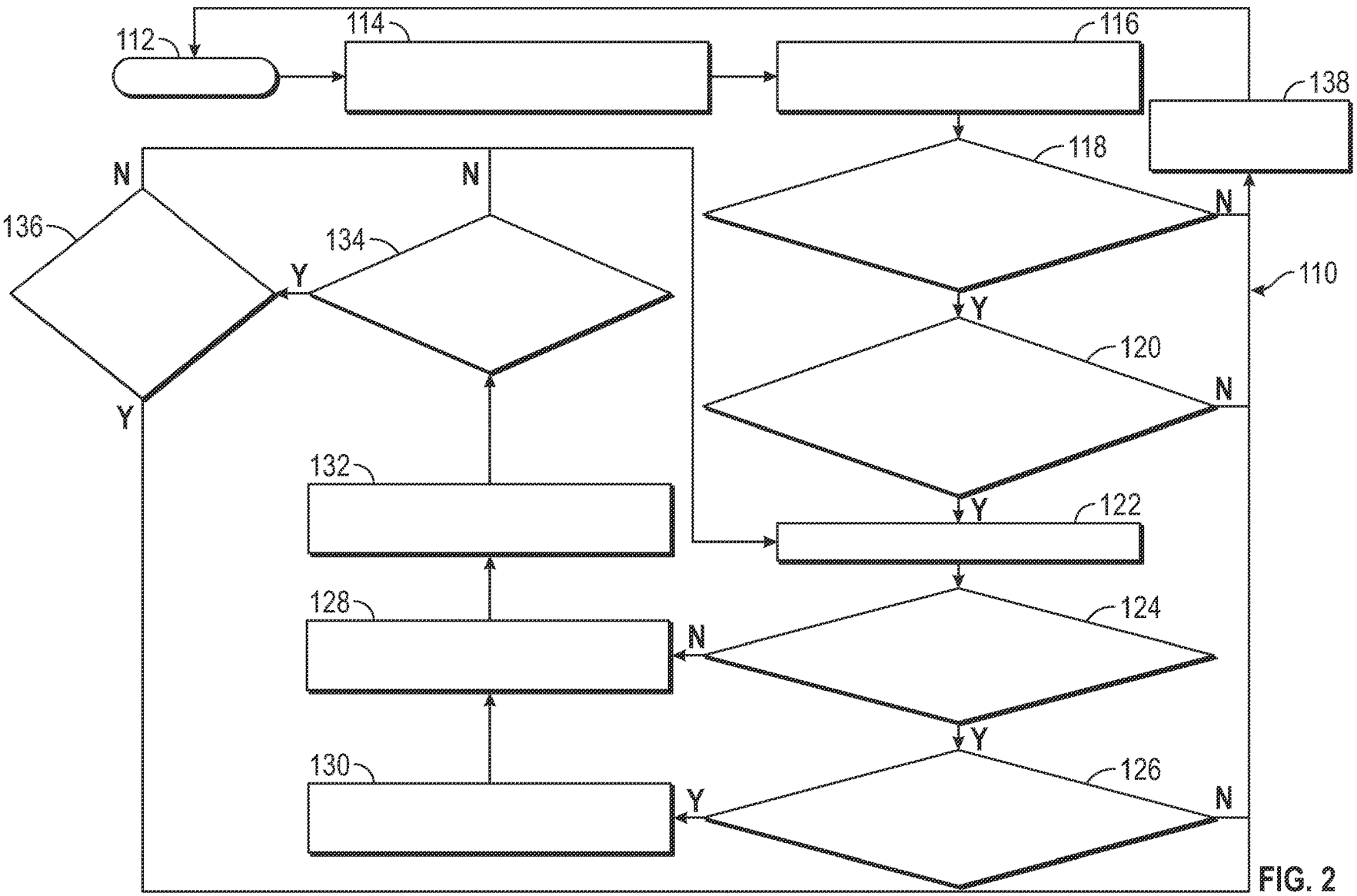
FIG. 2 is a diagram of a process for operating the coolant system shown in FIG. 1 according to an exemplary embodiment.

Referring now to FIG. 2, there is shown a process 110 for the operation of the coolant system 10. The process 110 beings in a step 112 and in a step 114 determines the current lube oil temperature, for example, with the sensor 56. In a step 116, the process 110 determines the lube oil temperature for optimal friction.

In a decision step 118, the process 110 decides if the current oil temperature is lower than an optimal temperature. If not, the process 110 turns off the piston cooling jets in a step 138. If so, the process 110 advances to a decision step 120, which decides if the temperature of the pistons are above a PM generation threshold. If not, the process 110 turns off the piston cooling jets in the step 138. If the temperature of the pistons is above a PM generation threshold, the process 110 turns on the piston cooling jets in a step 122.

Next, in a decision step 124, the process 110 decides if a target lube oil temperature has been achieved. If the target has not been achieved, the process 110 determines the total flow of the current lube oil in a step 128. If the target has been achieved, the process 110 advances to a decision step 126, where the process 110 turns off the piston cooling jets in the step 138 if piston heat rejection has not been utilized for knock suppression. If piston heat rejection for knock suppression has been achieved, the process 110 optimizes cooling of the engine block 96, the cylinder heads 92 and the turbo charger 94 in a step 130. The process then advances to the previously described step 128.

In a step 132, the process 110 determines the total lube flow demand. The process 110 decides in a step 134 if the demanded total lube flow is greater than the current lube flow. If not, the process 110 turns on the piston cooling jets in the step 122. If the demanded total lube flow is greater than the current lube flow, the process 110 advances to a decision step 136. In the step 136, the process 110 decides if the lube oil pump 16 is operating at maximum capacity. If the oil pump 16 is at maximum capacity, the process 110 turns off the piston cooling jets in the step 138. If the oil pump 16 is not at maximum capacity, the process 110 turns on the piston cooling jets in the step 122.

A coolant system 10 of the present disclosure offers several advantages. These include, for example, integration of a piston cooling jet circuit with on/off controls and linking energy absorption to a thermal management system for optimal friction control by controlling the lube oil temperature, while limiting particulate matter (PM) emissions. The process 110 is able to be overridden if there is an excess demand for lube oil from the hydraulic circuit.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A method for thermal management of a motor vehicle engine, the method comprising:
- determining a current lube oil temperature;
- determining a lube oil temperature for achieving a threshold friction;
- turning on piston cooling jets based on the current lube oil temperature and the lube oil temperature for achieving the threshold friction;
- turning off the piston cooling jets;
- deciding if a target lube oil temperature is achieved after the piston cooling jets are turned on;
- deciding if piston heat rejection for knock suppression is utilized when the target lube oil temperature is achieved, wherein if a piston heat rejection for knock suppression is not utilized, the piston cooling jet are turned off; and
- deciding if a demanded total lube flow is greater than a current lube flow when the target lube oil temperature is not achieved when the piston heat rejection for knock suppression is utilized.

2. The method of claim 1 further comprising deciding if the current lube oil temperature is lower than a threshold temperature, wherein if the current lube oil temperature is not lower than the threshold temperature, the piston cooling jets are turned off.

3. The method of claim 1, wherein if the demanded total lube flow is not greater than the current lube flow, the piston cooling jets are turned on.

4. The method of claim 1 further comprising deciding if a lube oil pump is operating at maximum capacity when the demanded total lube flow is greater than the current lube flow.

5. The method of claim 4, wherein if the lube oil pump is not operating at maximum capacity, the piston cooling jets are turned on.

6. The method of claim 4, wherein if the lube oil pump is operating at maximum capacity, the piston cooling jets are turned off.

7. The method of claim 1, wherein the piston cooling jets provide knock mitigation by operating the piston cooling jets above a target temperature for knock suppression.

8. The method of claim 7, wherein the piston cooling jets cool the lube oil with active control of the thermal management system with active cooling of the lube oil to a sump to achieve a target lube oil sump temperature.

9. A method for thermal management of a motor vehicle engine, the method comprising:
- determining a current lube oil temperature;
- determining a lube oil temperature for achieving a threshold friction;
- turning on piston cooling jets based on the current lube oil temperature and the lube oil temperature for achieving the threshold friction;
- turning off the piston cooling jets;
- deciding if the current lube oil temperature is lower than a threshold temperature, wherein if the current lube oil temperature is not lower than the threshold temperature, the piston cooling jets are turned off;
- deciding if a target lube oil temperature is achieved after the piston cooling jets are turned on;
- deciding if piston heat rejection for knock suppression is utilized when the target lube oil temperature is achieved, wherein if a piston heat rejection for knock suppression is not utilized, the piston cooling jet are turned off; and
- deciding if a demanded total lube flow is greater than a current lube flow when the target lube oil temperature is not achieved of when the piston heat rejection for knock suppression is utilized.

10. The method of claim 9, wherein if the demanded total lube flow is not greater than the current lube flow, the piston cooling jets are turned on.

11. The method of claim 9 further comprising deciding if a lube oil pump is operating at maximum capacity when the demanded total lube flow is greater than the current lube flow.

12. A method for thermal management of a motor vehicle engine, the method comprising:
- determining a current lube oil temperature;
- determining a lube oil temperature for achieving a threshold friction;
- turning on piston cooling jets based on the current lube oil temperature and the lube oil temperature for achieving the threshold friction;
- turning off the piston cooling jets;
- deciding if the current lube oil temperature is lower than a threshold temperature, wherein if the current lube oil temperature is not lower than the threshold temperature, the piston cooling jets are turned off;
- deciding if a target lube oil temperature is achieved after the piston cooling jets are turned on;
- deciding if piston heat rejection for knock suppression is utilized when the target lube oil temperature is achieved, wherein if a piston heat rejection for knock suppression is not utilized, the piston cooling jet are turned off;
- deciding if a demanded total lube flow is greater than a current lube flow when the target lube oil temperature is not achieved of when the piston heat rejection for knock suppression is utilized, wherein if the demanded total lube flow is not greater than the current lube flow, the piston cooling jets are turned on; and deciding if a lube oil pump is operating at maximum capacity when the demanded total lube flow is greater than the current lube flow.

13. The method of claim 12, wherein if the lube oil pump is not operating at maximum capacity, the piston cooling jets are turned on, and wherein if the lube oil pump is operating at maximum capacity, the piston cooling jets are turned off.

* * * * *